US008876582B2

(12) United States Patent
Gao et al.

(10) Patent No.: US 8,876,582 B2
(45) Date of Patent: Nov. 4, 2014

(54) VENTILATION DEVICE

(75) Inventors: Shouyong Gao, Guangdong (CN); Jingtao Yang, Guangdong (CN); Jianrong Zhu, Guangdong (CN); Zhenjian Yang, Guangdong (CN); Qingquan Liu, Guangdong (CN)

(73) Assignees: Panasonic Ecology Systems Guangdong Co., Ltd., Foshan, Guangdong (CN); Panasonic Corporation, Osaka (JP)

( * ) Notice: Subject to any disclaimer, the term of this patent is extended or adjusted under 35 U.S.C. 154(b) by 485 days.

(21) Appl. No.: 13/075,769

(22) Filed: Mar. 30, 2011

(65) Prior Publication Data

US 2012/0164936 A1 Jun. 28, 2012

(30) Foreign Application Priority Data

Dec. 27, 2010 (CN) ..... 2010 1 0624766

(51) Int. Cl.

| | |
|---|---|
| ***F24F 7/06*** | (2006.01) |
| ***F24F 7/007*** | (2006.01) |
| ***F24F 13/08*** | (2006.01) |
| *F24F 13/02* | (2006.01) |

(52) U.S. Cl.

CPC ..... *F24F 7/007* (2013.01); *F24F 13/0209* (2013.01)

USPC ..... 454/341; 454/349

(58) Field of Classification Search

USPC ..... 454/341, 344, 349, 354

See application file for complete search history.

(56) References Cited

U.S. PATENT DOCUMENTS

| | | | | | |
|---|---|---|---|---|---|
| 2,185,725 | A | * | 1/1940 | Elliott | 285/148.11 |
| 2,828,682 | A | * | 4/1958 | Marker | 454/354 |
| 3,173,710 | A | * | 3/1965 | Kinnison | 285/9.2 |
| 3,602,531 | A | * | 8/1971 | Patry | 285/148.23 |
| 3,606,396 | A | * | 9/1971 | Prosdocimo | 285/148.18 |
| 3,727,953 | A | * | 4/1973 | Martin et al. | 285/148.23 |
| 3,866,950 | A | * | 2/1975 | Skoch et al. | 285/4 |
| 4,067,072 | A | * | 1/1978 | Izzi | 4/288 |
| 4,249,758 | A | * | 2/1981 | Harris | 285/136.1 |
| 4,610,344 | A | * | 9/1986 | Eastman | 193/5 |
| 4,758,027 | A | * | 7/1988 | Todd | 285/148.23 |
| D297,043 | S | * | 8/1988 | Vander Wilt | D23/263 |
| 4,779,904 | A | * | 10/1988 | Rich | 285/345 |
| 4,867,640 | A | * | 9/1989 | Penlesky et al. | 415/204 |

(Continued)

FOREIGN PATENT DOCUMENTS

| | | |
|---|---|---|
| JP | 63003142 | 1/1988 |
| JP | 08145443 | 6/1996 |
| JP | 2007263559 | 10/2007 |

*Primary Examiner* — Steven B. McAllister
*Assistant Examiner* — Jonathan Cotov
(74) *Attorney, Agent, or Firm* — RatnerPrestia

(57) ABSTRACT

A ventilation device comprises: a body, a fan disposed In the body, and an adapter connected with an air outlet of the body. Two or more pipe coupling parts are disposed in sequence from a side of an air Inlet of the adapter to a side of an air outlet of the adapter, and each pipe coupling part is provided with a protruding circular ring with a diameter larger than that of the respective pipe coupling part at a root thereof. An air guide structure Is disposed in the adapter, a pipe is fitted over the pipe coupling part and Is abutted against the protruding circular ring located at the root to be fixed, and the air guide structure Is engaged to an inside of the protruding circular ring of the adapter.

7 Claims, 9 Drawing Sheets

(56) References Cited

U.S. PATENT DOCUMENTS

| | | | | | |
|---|---|---|---|---|---|
| 5,031,266 | A * | 7/1991 | Tillman et al. | 15/327.2 |
| 5,109,756 | A * | 5/1992 | Barboza et al. | 454/284 |
| 5,330,234 | A * | 7/1994 | Sweeny | 285/62 |
| 5,620,370 | A * | 4/1997 | Umai et al. | 454/354 |
| 5,820,458 | A * | 10/1998 | Lai | 454/354 |
| D404,122 | S * | 1/1999 | Hayashi et al. | D23/370 |
| 5,909,534 | A * | 6/1999 | Ko | 392/376 |
| 6,007,110 | A * | 12/1999 | Amatsutsu | 285/239 |
| 6,261,175 | B1 * | 7/2001 | Larson et al. | 454/354 |
| D453,817 | S * | 2/2002 | Patteson et al. | D23/262 |
| 6,361,432 | B1 * | 3/2002 | Walker | 454/290 |
| 6,435,964 | B1 * | 8/2002 | Chang | 454/349 |
| 6,464,578 | B1 * | 10/2002 | Chin et al. | 454/184 |
| 6,478,673 | B1 * | 11/2002 | Haynes | 454/292 |
| 6,640,461 | B1 * | 11/2003 | Berger | 34/140 |
| 6,895,874 | B2 * | 5/2005 | Gatley, Jr. | 110/341 |
| 6,902,373 | B1 * | 6/2005 | Glanton | 415/207 |
| 6,979,169 | B2 * | 12/2005 | Penlesky et al. | 415/1 |
| 7,055,866 | B2 * | 6/2006 | Tempas | 285/148.23 |
| 7,104,881 | B1 * | 9/2006 | Hyslop | 454/63 |
| 7,203,416 | B2 * | 4/2007 | Craw et al. | 392/350 |
| 7,286,350 | B2 * | 10/2007 | Lee et al. | 361/695 |
| 7,303,357 | B2 * | 12/2007 | Villarreal et al. | 405/36 |
| 7,455,500 | B2 * | 11/2008 | Penlesky et al. | 415/206 |
| 7,942,139 | B1 * | 5/2011 | Rockwell | 123/590 |
| 2001/0049260 | A1 * | 12/2001 | Larson et al. | 454/354 |
| 2003/0134588 | A1 * | 7/2003 | Larson et al. | 454/354 |
| 2007/0007762 | A1 * | 1/2007 | Hull et al. | 285/148.23 |
| 2007/0117502 | A1 * | 5/2007 | Kim | 454/139 |
| 2007/0228724 | A1 * | 10/2007 | Zuchara et al. | 285/148.1 |
| 2008/0182505 | A1 * | 7/2008 | Oosterhuis | 454/290 |
| 2008/0233856 | A1 * | 9/2008 | Okawa et al. | 454/143 |
| 2008/0261508 | A1 * | 10/2008 | Deng | 454/354 |
| 2008/0299891 | A1 * | 12/2008 | Deng | 454/354 |
| 2008/0318514 | A1 * | 12/2008 | Fettkether | 454/330 |
| 2008/0318515 | A1 * | 12/2008 | Yeung | 454/354 |
| 2009/0098818 | A1 * | 4/2009 | Gruenberg | 454/152 |
| 2009/0170421 | A1 * | 7/2009 | Adrian et al. | 454/349 |
| 2010/0009621 | A1 * | 1/2010 | Hsieh | 454/293 |
| 2010/0284803 | A1 * | 11/2010 | Yang | 415/204 |
| 2012/0273178 | A1 * | 11/2012 | Wanni et al. | 165/165 |

* cited by examiner

VENTILATION DEVICE

BACKGROUND OF THE INVENTION

1. Field of the Invention

The present application relates to a ventilation device, and particularly to a ventilation device mounted on a ceiling which communicates with an outside of a building through a pipe connected to a body for ventilation.

2. Description of the Related Art

A known ventilation device 10 is shown in FIG. 1. The ventilation device 10 comprises a body 11. A fan 12 is disposed in the body 11. Air blown from the fan 12 is discharged through a square air outlet 13 located on a side of the body 11. An adapter 14 is disposed at and connected with the square air outlet 13. The adapter 14 is connected to a pipe communicating with an outside of a building.

FIG. 2 is a schematic view showing structure of a known adapter. The adapter 14 is composed of a square air inlet 141, a circular air outlet 142, and a pipe coupling part 143. An engaging projection 1412 is disposed on an inner wall of the air inlet 141. The adapter 14 is connected with the air outlet 13 of the body 11 through the engaging projection 1412. The adapter 14 is connected with a pipe, which communicates with an outside of a building, through the pipe coupling part 143. A protruding ring 1413 is disposed at an end of the pipe coupling part 143 on an upstream side of the air outlet 13 of the adapter 14, and a plurality of protrusions 1414 are disposed on the protruding ring 1413 to prevent the pipe coupling part 143 of the adapter 14 from being inserted too deeply into the pipe when the pipe is connected with the pipe coupling part 143 of the adapter 14.

The adapter 14 of the prior art ventilation device mentioned above is designed after a diameter of the pipe connected therewith is estimated in advance. In other words, the adapter 14 is suitable only for pipes with the same diameter. In order to satisfy laws and regulations of the regions where the ventilation device is installed, it is difficult to connect the pipe coupling part of the adapter of the ventilation device to a pipe with a different diameter from that of the pipe coupling part.

When a pipe sealing adhesive tape adheres after the pipe coupling part 143 is inserted into the pipe, air possibly leaks from a gap between the adhesive tape and an adhesion surface due to the irregular adhesion surface since the pipe coupling part 143 of the adapter 14 is provided with the protruding ring 1413 and the plurality of the protrusions 1414 to position the pipe.

In addition, when the adapter 14 is fixed, air will leak when an air flow generated by the fan 12 is blown towards the air inlet 13 of the adapter 14 since the body 11 is provided with an opening 111 engaging with the engaging projection 1412 on an inner wall of the square air inlet 13 and a gap exists where the body 11 is connected with the adapter 14 even after the adapter 14 is fixed through the engaging projection 1412.

SUMMARY OF THE INVENTION

It is an object of the present invention to provide a ventilation device which can be easily installed.

In order to achieve the above object, the present invention provides a ventilation device. The ventilation device comprises: a body, a fan disposed in the body, an adapter connected with a body air outlet, two or more pipe coupling parts are disposed in sequence from a side of an air inlet of the adapter to a side of an air outlet of the adapter. Each of the pipe coupling parts is provided with a protruding circular ring with a diameter larger than that of the respective pipe coupling part at a root thereof. An air guide structure is also disposed in the adapter. A pipe is fitted over the pipe coupling part and is abutted against the protruding circular ring at the root to be fixed. The air guide structure is engaged to an inside of the protruding circular ring of the adapter.

A connection plane where the adapter and the body are connected with each other is formed by a flat plate, and a flange is disposed on at least one side of the flat plate coming into contact with an edge of the body and the flange is bent at a right angle to the connection plane.

The pipe coupling parts are concentrically disposed.

An inner diameter of the air guide structure at an end thereof is the same as an inner diameter of a first pipe coupling part of the pipe coupling parts, and an inner diameter of the air guide structure at another end thereof is the same as an inner diameter of the air outlet of the body of the ventilation device, so that an air path between the body air outlet and the first pipe coupling part smoothly transits.

An engaging part is disposed at a periphery of the air guide structure, and the protruding circular ring is provided with an opening engaging with the air guide structure and has a length in a direction in which the pipe coupling part is inserted into the pipe for disposing a sealing device at the opening.

The sealing device is an adhesive tape.

An extension wall is disposed on at least one side of an air inlet of the air guide structure to be extended towards an outer periphery of the air inlet.

A protrusion is disposed on a side of the air guide structure, a connection plane where the adapter and the body is connected with each other is formed by a flat plate, and a notch is disposed on a corresponding side of the flat plate of the adapter. The protrusion can be inserted into the notch.

The ventilation device according to the present invention has the following advantages. Pipes with different outer diameters can be conveniently installed to the ventilation device. In addition, excellent seal and reduction of air resistance and noise can be achieved.

BRIEF DESCRIPTION OF THE DRAWINGS

The above and/or other aspects and advantages of the present invention will become apparent and more readily appreciated from the following description of the exemplary embodiments, taken in conjunction with the accompanying drawings, in which.

DETAILED DESCRIPTION OF THE EMBODIMENTS

Figure 1:
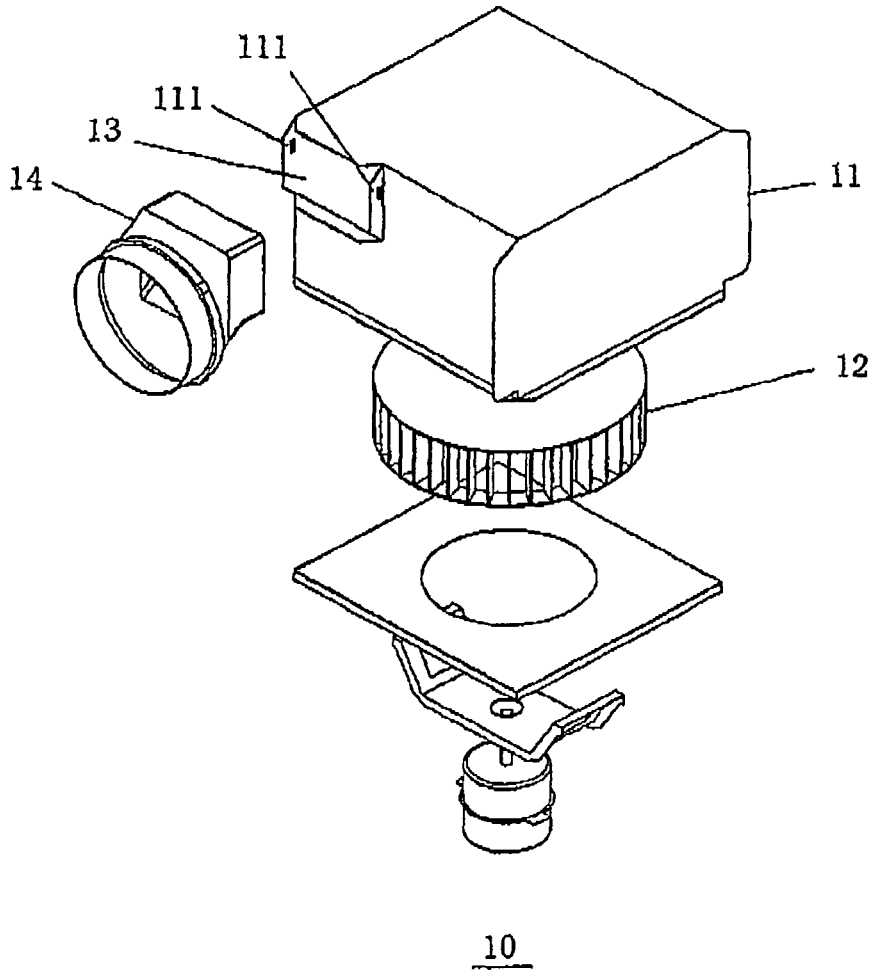
Fig. 1 PRIOR ART
FIG. 1 is a schematic view showing a structure of a prior art ventilation device.
Figure 2:
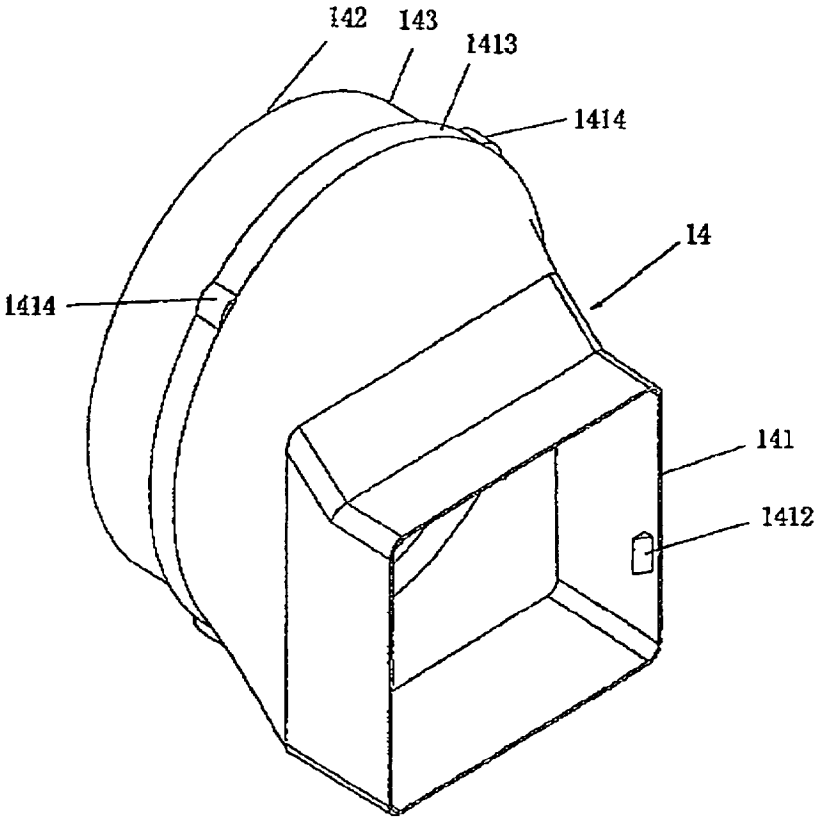
Fig. 2 PRIOR ART
FIG. 2 is a schematic view showing a structure of a prior art adapter.

Reference will now be made in detail to the embodiments of the present invention, examples of which are illustrated in the accompanying drawings, wherein like reference numerals refer to like elements throughout. The embodiments are described below so as to explain the present invention by referring to the figures and the present invention should not be construed as being limited to the embodiments set forth herein.

Figure 3:
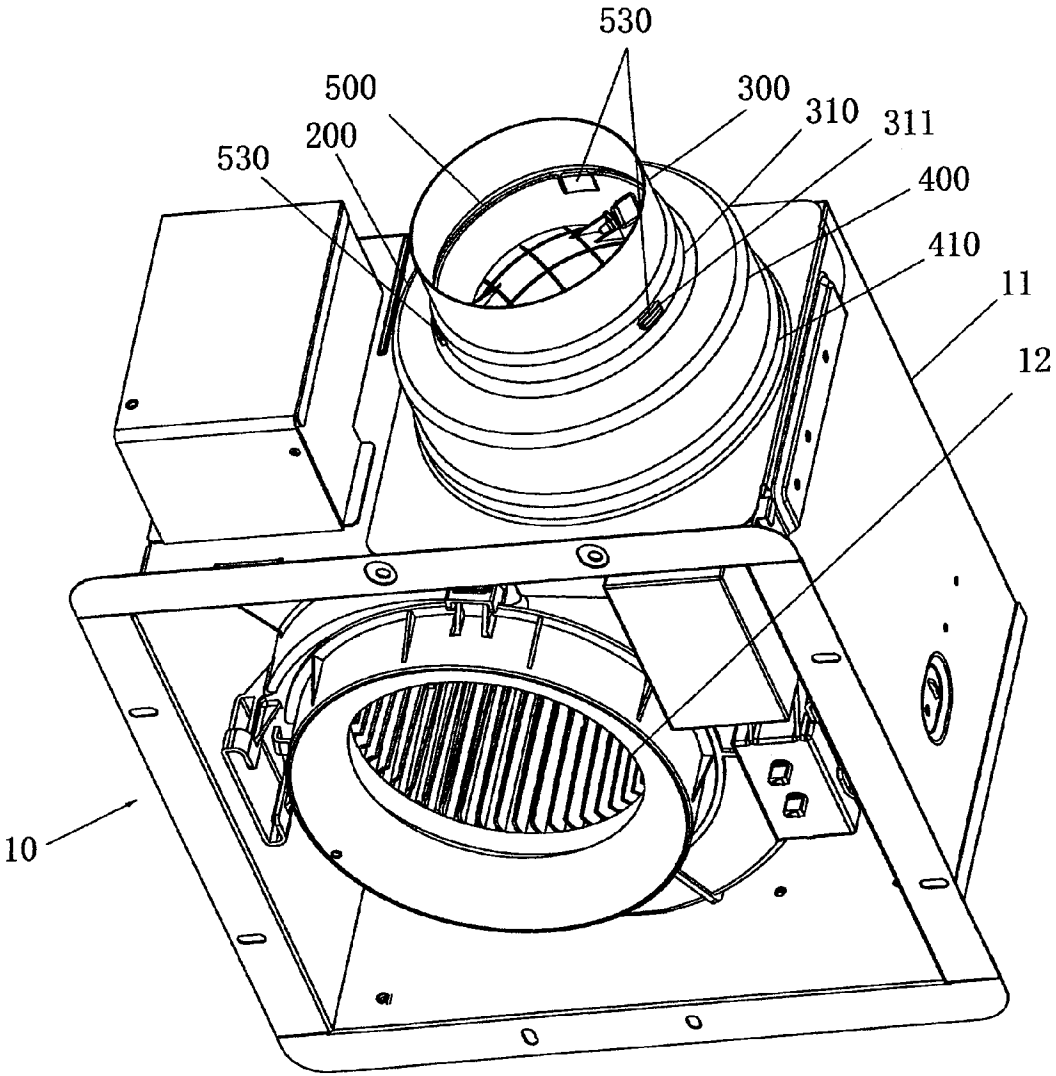
FIG. 3 is a schematic perspective view of a ventilation device according to a first embodiment of the present invention.

FIG. 3 is a schematic perspective view of a ventilation device according to a first embodiment of the present invention. As shown in FIG. 3, the ventilation device 10 comprises: a body 11, a fan 12 disposed in the body 11, and an adapter 200 connected with a body air outlet (not shown). The air inlet of the adapter 200 is connected to the body air outlet. An air outlet of the adapter 200 is connected to a pipe for discharging air from the ventilation device 10 to an outside of a building.

In other words, the air inlet of adapter 200 and the body air outlet have respective openings of the same size. The air outlet of the adapter 200 has a same size as that of a corresponding minimum pipe. An air guide structure 500 is disposed in the adapter 200 so that the air inlet and the air outlet of the adapter can be smoothly communicated with each other.

Figure 4:
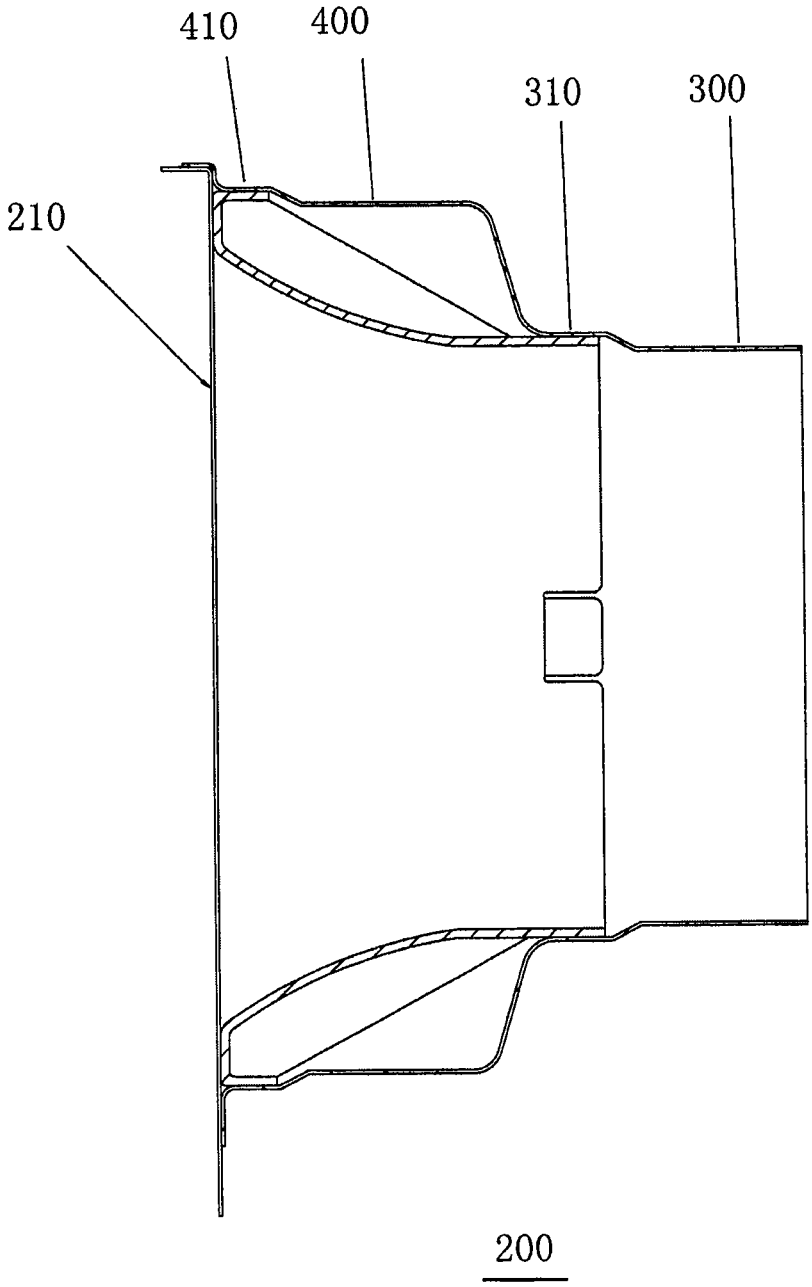
FIG. 4 is a schematic sectional view of an adapter of the ventilation device according to the first embodiment of the present invention.

FIG. 4 is a schematic sectional view of the adapter according to the first embodiment. The adapter of the present invention is provided with two or more pipe coupling parts rather than one pipe coupling part. In the embodiment, two concentric pipe coupling parts 400 and 300 are disposed in sequence from a side 210 of the air inlet of the adapter 200 to a side of the air outlet of the adapter 200. The pipe coupling part 300 of a small size is defined as a first pipe coupling part, and the pipe coupling part 400 of a large size is defined as a second pipe coupling part. The pipe coupling part 300 is provided with a first protruding circular ring 310 with a diameter larger than that of the pipe coupling part 300 at a root thereof, and the pipe coupling part 400 is provided with a second protruding circular ring 410 with a diameter larger than that of the pipe coupling part 400 at a root thereof. In other words, the second protruding circular ring 410, the second pipe coupling part 400, the first protruding circular ring 310, and the first pipe coupling part 300 are disposed in sequence from the side 210 of the air inlet of the adapter 200 to the side of the air outlet of the adapter 200 based on outer sizes thereof. The concentric pipe coupling parts 300 and 400 are advantageous in that air can be smoothly blown to the pipe from the body air outlet through the adapter 200 due to absence of high-pressure and low-pressure regions in spite of a size of the actually installed pipe, and that the adapter 200 can be easily manufactured due to the concentric arrangement and possibility of tear of the adapter reduces.

Therefore, with the above structure, the adapter applicable to pipes of different sizes can be manufactured by means of only one set of dies, and it is not necessary to use a plurality of sets of dies for manufacturing adapters of different sizes so that cost for manufacturing the dies is saved. In addition, the first protruding circular ring 310 is disposed between the pipe coupling parts 300 and 400 of different sizes to connect the pipe coupling parts 300 and 400 as shown in FIG. 3. Therefore, the first protruding circular ring 310 can limit the position of the pipe. For example, the two pipe coupling parts have diameters of 4 inches and 6 inches, respectively. The two pipe coupling parts are connected with each other through the protruding circular ring at the root. According to actual requirements, during installation, when the 4-inch pipe is needed, the 4-inch pipe is fitted over the first pipe coupling part 300 until it is abutted against the first protruding circular ring 310. The first protruding circular ring 310 has a diameter greater than that of a connection section of the first pipe 300. Therefore, after the pipe is fitted over the first pipe coupling part 300 of the adapter 200, it will not be too deeply fitted over the adapter 200 by limiting the position of the pipe by means of the protruding circular ring 310. When 6-inch pipe is needed, the 6-inch pipe is also fitted over the second pipe coupling part 400 until it reaches to the second protruding circular ring 410. The pipe will not be too deeply fitted over the adapter 200 by limiting the position of the pipe by means of the second protruding circular ring 410. Hence, assembling of the pipe and the pipe coupling part of the adapter can be simply completed.

Figure 5:
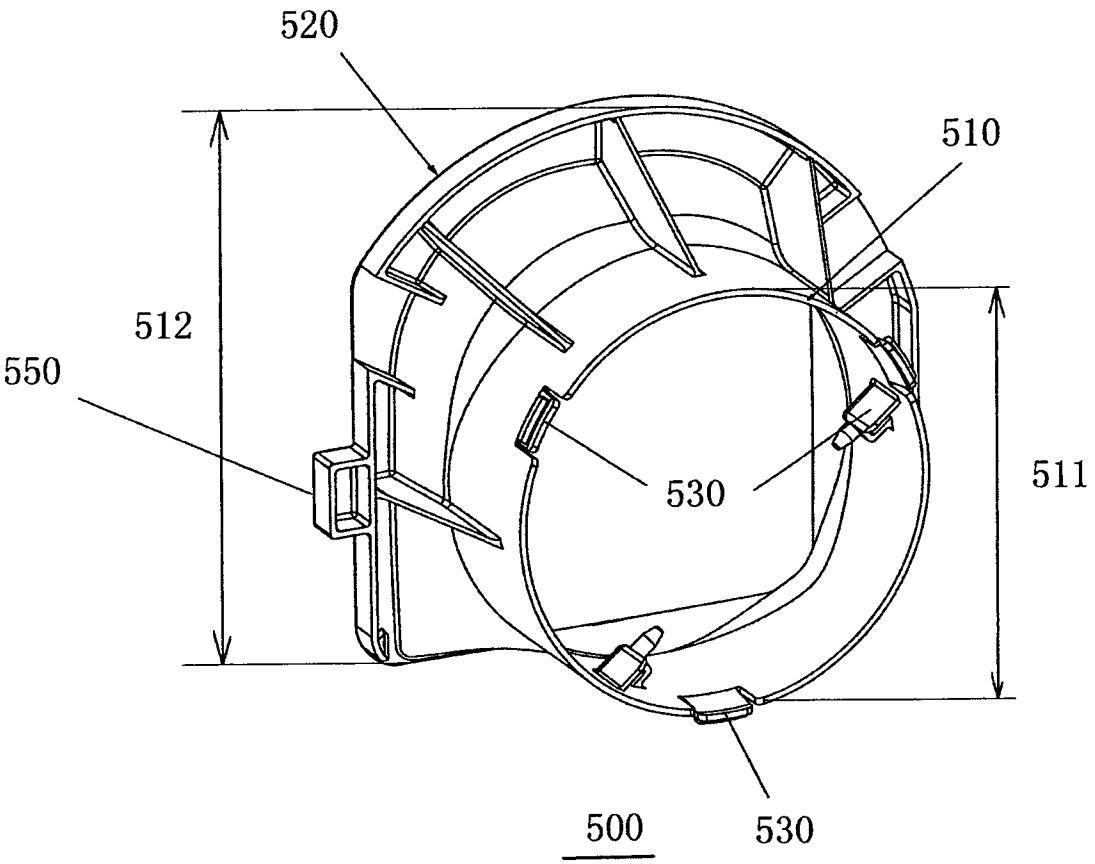
FIG. 5 is a schematic view of an air guide structure of the ventilation device according to the first embodiment of the present invention.

FIG. 5 is a schematic view of the air guide structure of the ventilation device according to the first embodiment. The air guide structure 500 has an inner diameter 511 as the same as that of the first pipe coupling part 300 at an end on a side 510 of an air outlet. The air guide structure 500 further has an inner diameter 512 as the same as that of the body air outlet 13 of the ventilation device at another end on a side 520 of an air inlet. An engaging part 530 is disposed at a periphery of the air guide structure 500. Referring to FIG. 3, the first protruding circular ring 310 of the first pipe coupling part 300 is provided with an opening 311 engaging with the engaging part 530 of the air guide structure.

When the pipe is installed, the pipe is fitted over the pipe coupling part 300 or 400 and is abutted against the protruding circular ring 310 or 410 at the root to be fixed. The air guide structure 500 is engaged to an inside of the first protruding circular ring 310. Since the air guide structure 500 is disposed at an air path formed by the first pipe coupling part 300 and the second pipe coupling part 400 of the adapter 200, a position difference of sections of the air path smoothly transits and connects so that air resistance lowers.

Furthermore, the first protruding circular ring 310 protrudes outwards from the pipe coupling part 300 although the engaging part 530 is disposed at the periphery of the air guide structure 500 to fasten the air guide structure 500 to the first protruding circular ring 310 of the adapter 200. Therefore, even if the air guide structure 500 is disposed, the air guide structure 500 will not adversely affect a sectional area of the air outlet of the adapter 200 due to a thickness of the air guide structure 500 and the engaging part 530 will not interfere in fitting the pipe over the pipe coupling part. The stability of properties of the product is thus improved.

Figure 6:
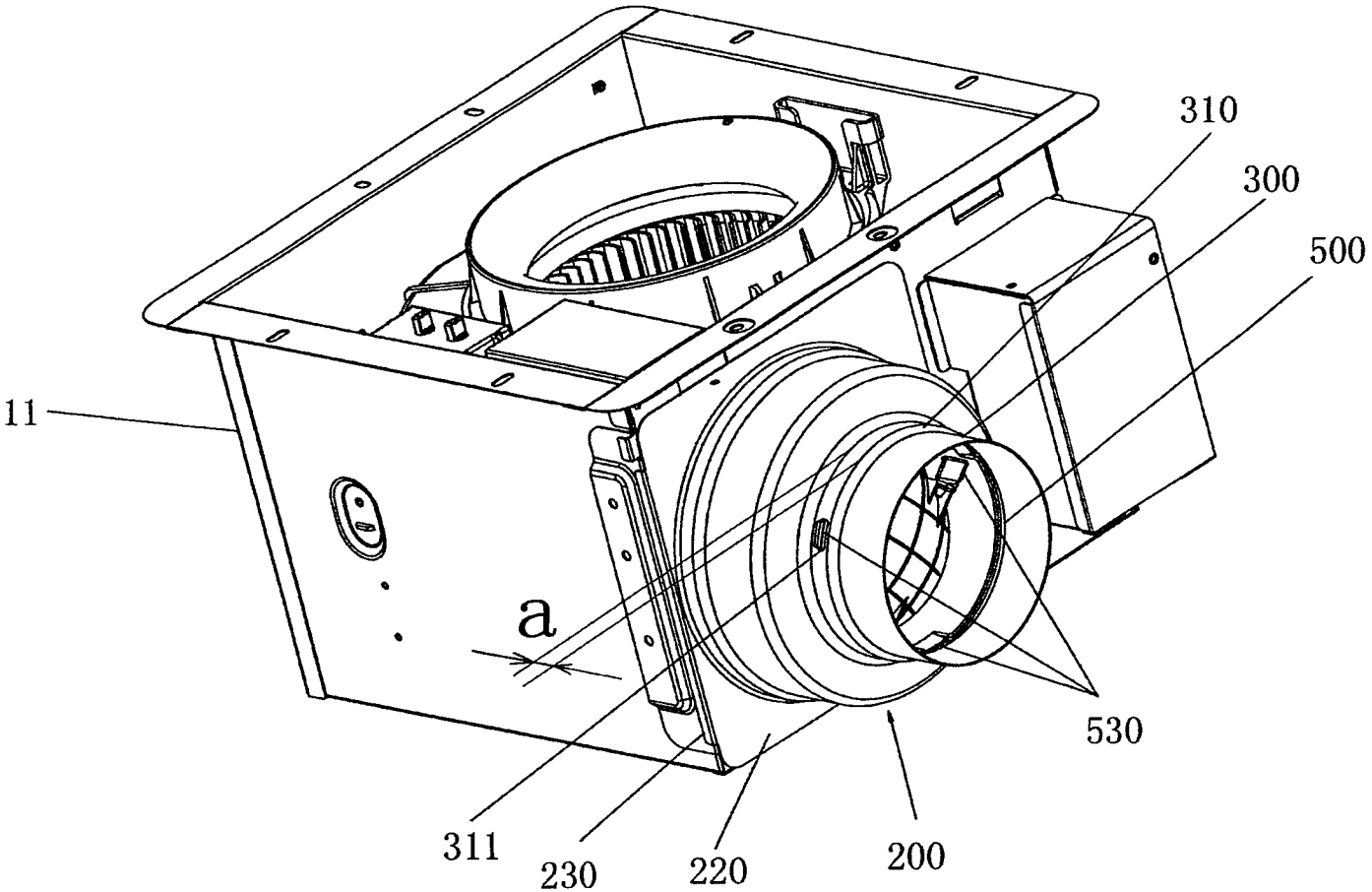
FIG. 6 is a schematic view showing the assembled ventilation device according to the first embodiment.
Figure 7:
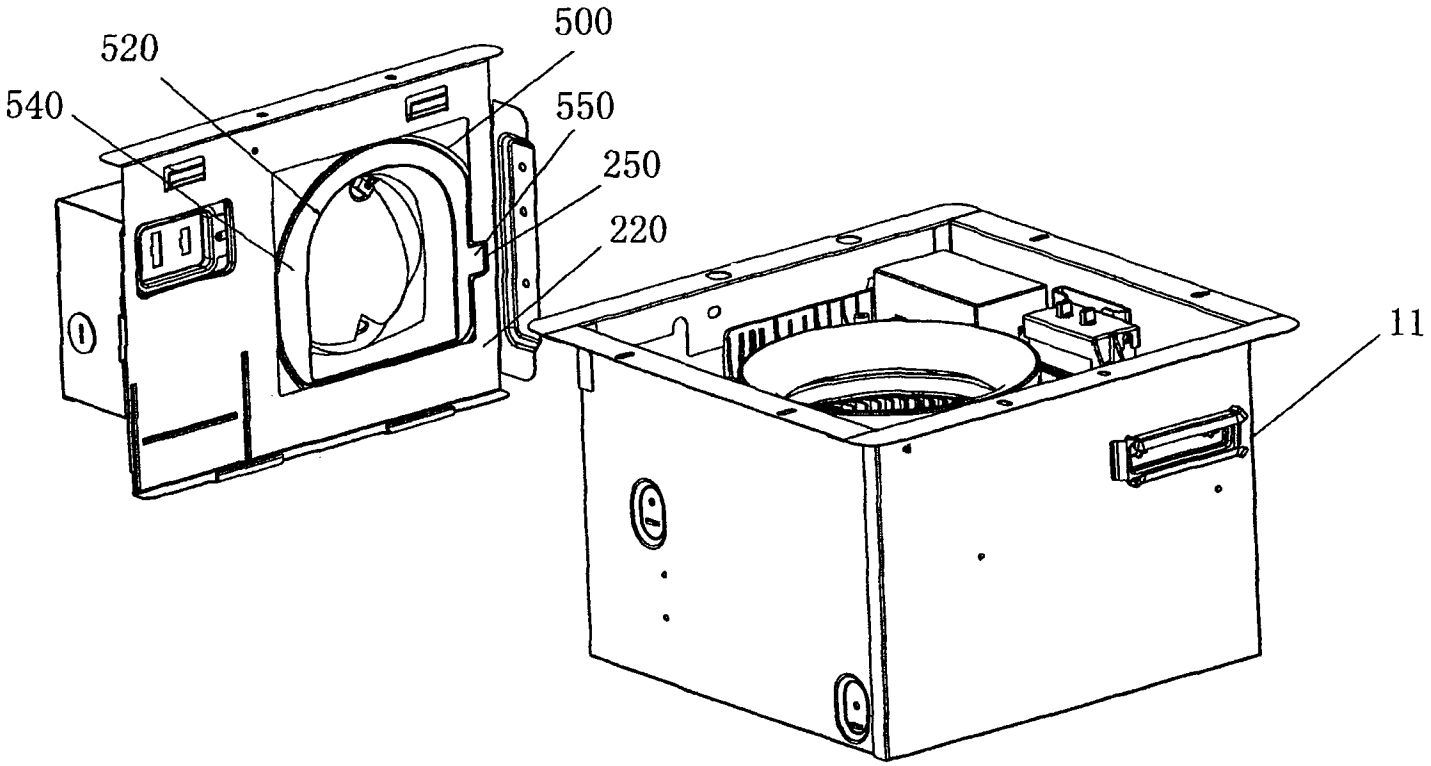
FIG. 7 is another schematic view showing the assembled ventilation device according to the first embodiment.

FIGS. 6 and 7 are schematic views showing the assembled ventilation device according to the first embodiment. As shown in FIG. 6, the first protruding circular ring 310 has a length a in a direction in which the pipe coupling part is inserted into the pipe. A sealing device is disposed at the opening 311 of the first protruding circular ring 310. For example, an adhesive tape is used to seal the opening 311. Therefore, air leakage can be effectively prevented and thereby noise lowers.

As shown in FIG. 7, a protrusion 550 is also disposed at a side edge of the air guide structure 500 on the side 520 of the air inlet, and a corresponding notch 250 is disposed at the flat plate 220 of the adapter 200. The protrusion 550 can be inserted into the notch 250. With the above configuration, when the air guide structure 500 is installed to the adapter 200, the air guide structure can be temporarily fastened inside the adapter 200 after the protrusion 550 is engaged in the notch 250 of the flat plate 220 of the adapter, and then the engaging part 530 of the air guide structure 500 is engaged in the opening 311 of the first protruding circular ring 310, thereby simply completing installing of the air guide structure according to a correct orientation of the air guide structure.

An extension wall 540 is disposed at another side edge of the air guide structure 500 on the side 520 of the air inlet to be extended towards an outer periphery of the air inlet. The extension wall 540 is positioned opposite the protrusion 550. The extension wall 540 is extended to an edge of the air inlet of the adapter 200. After the adapter 200 is fixed to the body 11, the air guide structure 500 can be tightly abutted against the body 11 to further prevent air from leaking from between the air outlet of body 11 and the air inlet side 520 of the adapter 200. The noise thus lowers.

A connection plane where the adapter 200 is connected with the body 11 is formed by a flat plate 220, and a flange 230 is disposed on a side of the flat plate 220 coming into contact with an edge of the body 11, and the flange 230 is bent at a right angle to the connection plane 220. With the above configuration, when the adapter 200 is installed, the adapter 200 can be easily and accurately moved to an appropriate installation position and temporarily positioned by guiding of the flange 230, and after that, the adapter 200 is fixed to the body 11 by riveting, a screw, butt welding or the like. In addition, since the flat plate 220 is tightly abutted against the body 11 and formed with the flange 230, air is prevented from leaking from a gap between the body 11 and the adapter 200 through the connection plane 220.

After the adapter is installed, air is blown from the body air outlet and then discharged to an outside of a building through the air guide structure in the adapter and then through the pipe. Therefore, an air path through which air passes the adapter is uniform regardless of a size of the employed pipe. In other words, the air can be smoothly blown from the air outlet of the body 11 to the pipe through air guide structure 500 regardless of the pipe coupling part of which size the pipe is fitted over. Thus, the above configuration can avoid unevenness of air, generation of turbulent flow, reduction of flow rate of air, and an increase of noise caused by collision of air onto a wall of the adapter when the air is blown from the large-diameter pipe coupling part 400 to the small-diameter pipe coupling part 300.

Figure 8:
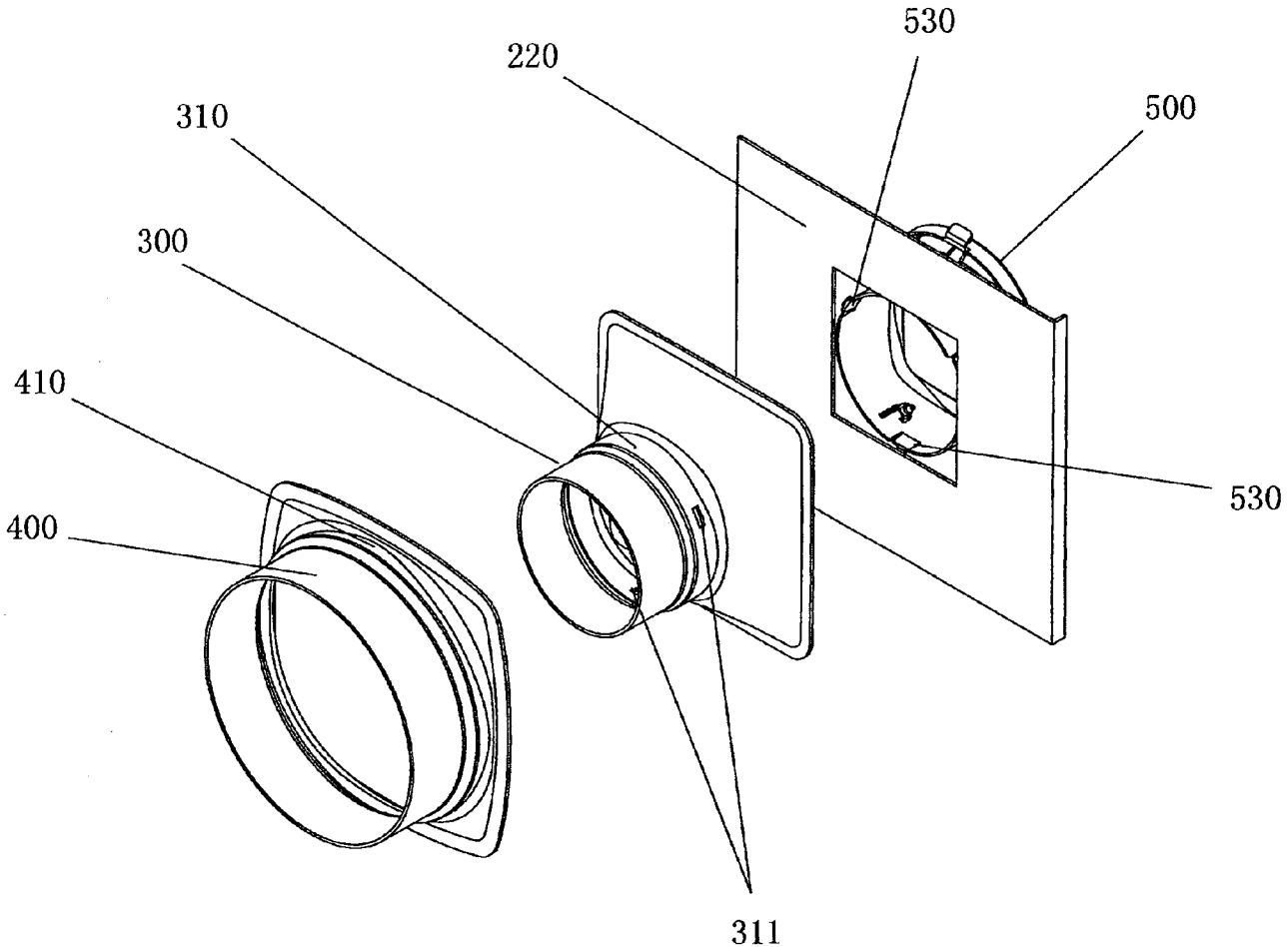
FIG. 8 is a schematic perspective view of an adapter of a ventilation device according to a second embodiment of the present invention.
Figure 9:
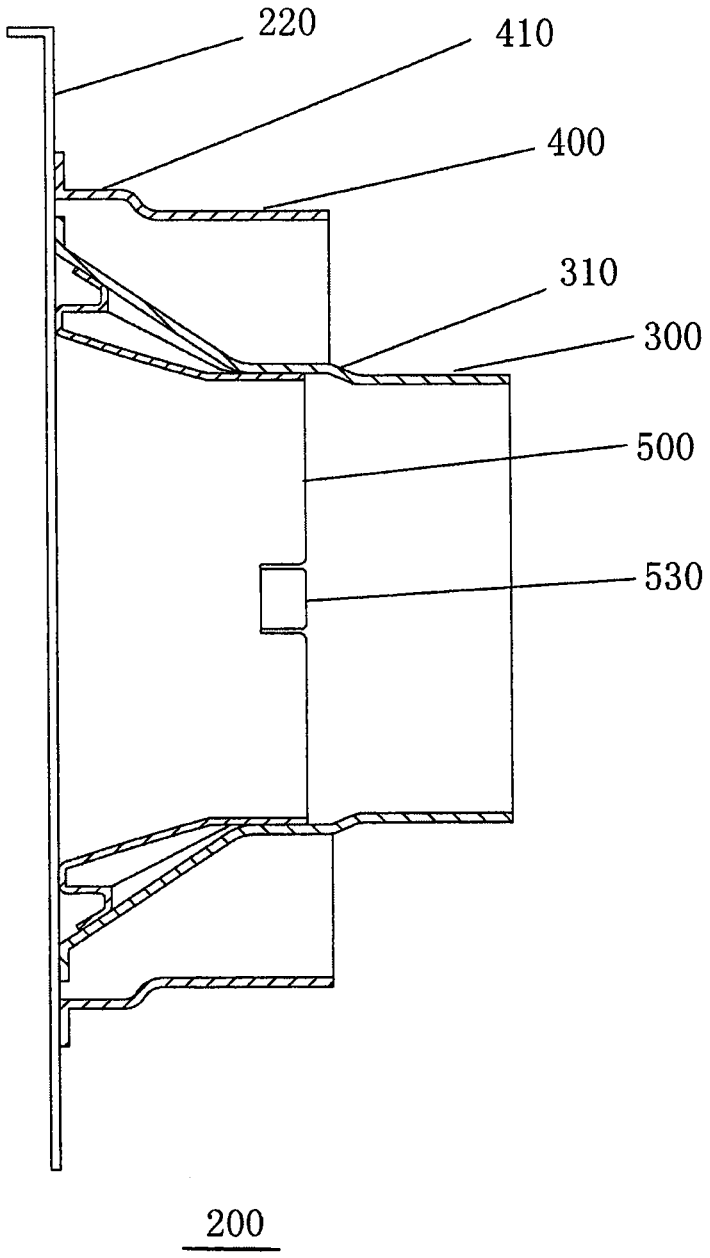
FIG. 9 is a schematic sectional view of the adapter according to the second embodiment.

FIG. 8 is a schematic perspective view of an adapter of a ventilation device according to a second embodiment of the present invention and FIG. 9 is a schematic sectional view of the adapter according to the second embodiment. The second embodiment is different from the first embodiment in that the first pipe coupling part 300 extends to the flat plate 220 as shown in FIGS. 8 and 9. In other words, the first pipe coupling part 300 and the second pipe coupling part 400 are separately formed. Only a size of the second pipe coupling part 400 is necessarily changed and the whole adapter 200 need not be replaced when the adapter is applied to a pipe of a different size. Therefore, flexibility of the adapter is improved. The remaining configuration of the ventilation device according to the second embodiment may be adaptively adjusted based on the ventilation device of the first embodiment. The air guide structure 500 is fixed in the same manner in the second embodiment as in the first embodiment. The engaging part 530 is disposed at the periphery of the air guide structure. The first protruding circular ring 310 of the first pipe coupling part 300 is provided with the opening 311 engaged with the engaging part 530 of the air guide structure. When a pipe is installed, the pipe is fitted over the pipe coupling part 300 or 400 to be abutted against the protruding circular ring 310 or 410 at the root so that the pipe is fixed. The air guide structure 500 is engaged to an inside of the first protruding circular ring 310. Since the air guide structure 500 is disposed at an air path formed from the first protruding circular ring 310 to the flat plate 220, a position difference of sections of the air path from the first pipe coupling part 300 to the body air outlet is smoothly transitional and continuous so that air resistance lowers.

Furthermore, in the second embodiment, although the air guide structure 500 as a separate element is disposed at the air path from the first protruding circular ring 310 to the flat plate 220, the air guide structure 500 may be installed to the flat plate 220 after the air guide structure 500 is integrally formed with the first protruding circular ring 310 and the first pipe coupling part 300, or the air guide structure 500 may be integrally formed with the first protruding circular ring 310, the first pipe coupling part 300, and the flat plate 220. In other words, only one set of dies are used to manufacture the adapter applicable to pipes of different sizes. Therefore, it is not necessary to use a plurality of sets of dies for manufacturing adapters corresponding to pips of different sizes so that cost for manufacturing the dies is saved.

While the embodiments of the present invention has been shown and described, it will be understood by those skilled in the art that various changes, modifications, substitutions and alterations may be made therein without departing from the principles and spirit of the present invention.

The invention claimed is:

1. A ventilation device comprising: a body, a fan disposed in the body, and an adapter connected with an air outlet of the body, wherein:

a first pipe coupling part, a first protruding circular ring, a second pipe coupling part and a second protruding circular ring are disposed in sequence from a side of an air outlet of the adapter to a side of an air inlet of the adapter, and the first and second pipe coupling parts are provided with the first and second protruding circular rings, respectively, wherein the each of the first and second protruding circular rings of the respective first and second pipe coupling parts has a diameter larger than a diameter of the respective first and second pipe coupling part at a root of the respective first and second pipe coupling part;

an air guide structure is disposed in the adapter, a pipe is fitted over one of the first and second pipe coupling parts and is abutted against one of the first and second protruding circular rings at the root of the one of the first and second pipe coupling parts so that the pipe is fixed, and the air guide structure has an end, wherein the end of the air guide structure is engaged to an inside of the first protruding circular ring, wherein the first pipe coupling part is located on the side of the air outlet of the adapter, wherein a diameter difference between the first pipe coupling part and the first protruding circular ring is smaller than a diameter difference between the first protruding circular ring and the second pipe coupling part, and a diameter difference between the second pipe coupling part, and the second protruding circular ring is smaller than a diameter difference between the first protruding circular ring and the second pipe coupling part, and wherein a first inner diameter of the air guide structure at a first end of the air guide structure is the same as an inner diameter of the first pipe coupling part, and a second inner diameter of the air guide structure at a second end of the air guide structure is the same as an inner diameter of the air body outlet of the ventilation device, so that air smoothly transits between the body air outlet and the first pipe coupling part, and wherein the second inner diameter of the air guide structure is larger than the first inner diameter of the air guide structure.

2. The ventilation device of claim 1, wherein a connection plane where the adapter and the body are connected with each other is formed by a flat plate, and a flange is disposed on at least one side of the flat plate coming into contact with an edge of the body, and the flange is bent at a right angle to the connection plane.

3. The ventilation device of claim 1, wherein the first and second pipe coupling parts are concentrically disposed.

4. The ventilation device of claim 1, wherein an engaging part is disposed at a periphery of the air guide structure, and the first protruding circular ring is provided with an opening engaging with the air guide structure and has a length in a direction in which one of the first and second pipe coupling parts is inserted into a pipe, the length being used for disposing a sealing device at the opening.

5. The ventilation device of claim 4, wherein the sealing device is an adhesive tape.

6. The ventilation device of claim 1, wherein an extension wall is disposed on at least one side of an air inlet of the air guide structure to be extended towards an outer periphery of the air inlet.

7. The ventilation device of claim 1, wherein a protrusion is disposed on a side of the air guide structure, a connection plane where the adapter and the body is connected with each other is formed by a flat plate, a notch is disposed on a corresponding side of the flat plate of the adapter, and the protrusion can be inserted into the notch.

* * * * *